United States Patent [19]

Kamal

[11] 4,273,059

[45] Jun. 16, 1981

[54] X-Y ALTERNATING DRIVE PROFILING SYSTEM

[76] Inventor: Nabil Kamal, 8166 St. Denis, Montreal, Quebec, Canada, H2P 2G6

[21] Appl. No.: 137,624

[22] Filed: Apr. 7, 1980

[51] Int. Cl.[3] ..... D05B 3/00; D05B 21/00

[52] U.S. Cl. ..... 112/121.14

[58] Field of Search ..... 112/121.11, 121.14, 112/121.12, 121.15, 121.29

[56] References Cited

U.S. PATENT DOCUMENTS

| | | | |
|---|---|---|---|
| 3,001,489 | 9/1961 | Bond et al. | 112/121.12 |
| 3,164,112 | 1/1965 | Bono | 112/121.12 |
| 3,170,423 | 2/1965 | Henebry | 112/121.12 |
| 3,208,415 | 9/1965 | Reeber | 112/121.12 |
| 3,450,076 | 6/1969 | Bender | 112/121.12 X |
| 3,497,780 | 2/1970 | Leenhouts | 112/121.12 X |
| 3,765,349 | 10/1973 | Gerber | 112/121.14 |

*Primary Examiner*—H. Hampton Hunter
*Attorney, Agent, or Firm*—Guy J. Houle; Robert E. Mitchell; Alan Swabey

[57] ABSTRACT

A profiling system comprising a profile member having a profile guide element. The profile member is displaceable along a first straight axis. A working head is fixedly secured relative to a work support surface and spaced relative to the profile member. The working head and the support surface are mounted on a head support frame displaceable along a second straight axis extending transversely to the first axis. Support members are secured relative to the profile member and displaceable therewith to retain and displace a material to be worked on by the head. A follower element is fixedly secured to the head support frame and displaceably engaged with the profile guide element. The head support frame is displaced along the second axis in response to angular deviations from the first straight axis as defined by a path delineated by the profile guide element as the guide element is drivingly displaced along the first axis. The guide member is displaced along the first axis in response to angular deviation from the second straight axis as defined by the path as the head support frame is drivingly displaced along the second axis.

8 Claims, 2 Drawing Figures

FIG. 1
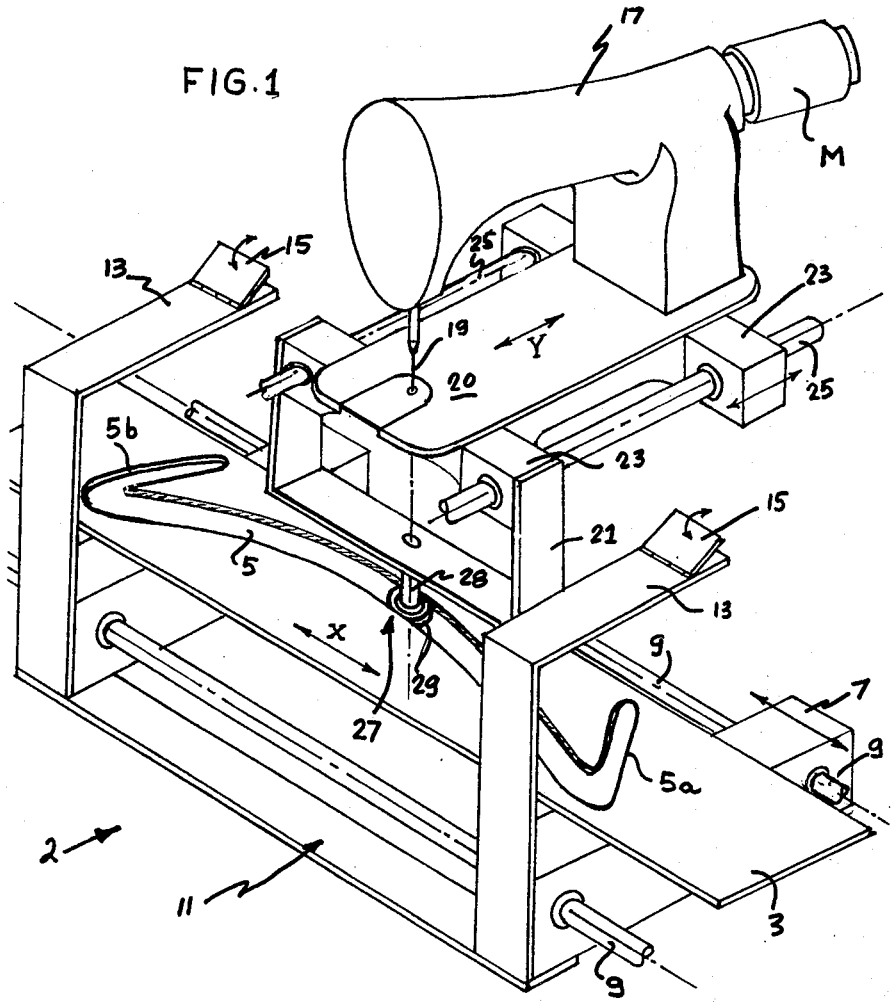
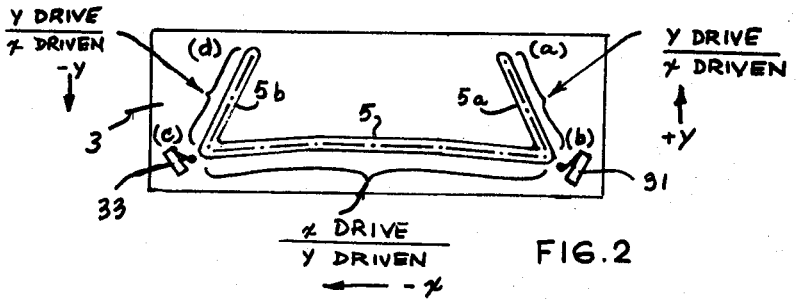
FIG. 2

X-Y ALTERNATING DRIVE PROFILING SYSTEM

BACKGROUND OF INVENTION (a) Field of Invention

This invention relates to a profiling system wherein a working head performs a predetermined function along a path delineated by a profile guide element. The profile element and the working head are displaced along respective straight transverse axes and require minimum inertia for their displacement along their respective axes.

(b) Description of Prior Art

Various types of profiling systems are known, and particularly for use with sewing machines wherein a sewing pattern is effected on a fabric displaceable on a work support surface. The fabric or the head is usually displaced in accordance with the profile element with the head or the fabric remaining stationary. Accordingly, the head or the material being worked on must be manipulated along all paths delineated by a given profile and this requires complex machinery, drive and couplings to effect such manoeuvering of the stitching head or the material.

SUMMARY OF INVENTION

It is a feature of the present invention to substantially overcome the above-mentioned disadvantage of the prior art by the provision of a profiling system wherein the head and fabric being worked on are displaceable, simultaneously, along respective straight transverse axes while the head effects a work function delineated by a profile guide element.

A further feature of the present invention is to provide a profiling system wherein both the material being worked on and the head are displaceable respectively in opposed transverse axes.

According to the above features, from a broad aspect, the present invention provides a profiling system comprising a profile member having a profile guide element. The profile member is displaceable along a first straight axis. A working head is fixedly secured relative to a work support surface and spaced relative to the profile member. The working head and support surface are mounted on a head support frame displaceable along a second straight axis extending transversely to the first axis. Support means is secured relative to the profile member and displaceable therewith to retain and displace a material to be worked on by the head. A follower element is fixedly secured to the head support frame and displaceably engaged with the profile guide element. The head support frame is displaced along the second axis in response to angular deviations from the first straight axis as defined by a path delineated by the profile guide element as the guide element is drivingly displaced along the first axis. The guide member is displaced along the first axis in response to angular deviation from the second straight axis as defined by the path as the head support frame is drivingly displaced along the second axis.

DESCRIPTION OF DRAWINGS

A preferred embodiment of the present invention will now be described with reference to the example thereof as illustrated in the accompanying drawings in which:

FIG. 1 is a perspective fragmented view of the profile system as utilized with a sewing machine, and FIG. 2 is a plan view of the profile guide element.

DESCRIPTION OF PREFERRED EMBODIMENTS

Referring now to the drawings, the system, illustrated generally at 1, includes a profile guide means, such as guide plate 3 having a profile guide element, such as a cam slot 5. The guide plate is fixedly mounted on movable workpiece carriage 7. The carriage is movable along axis X on carriage guide shafts 9.

Mounted on the carriage 7 is frame 11 including material clamp arms 13 having clamps 15 disposed at the free ends thereof. The workpiece, in this case, a length of cloth, is disposed on the upper surface of the arms 13 and clamped in place by the clamps 15. As will be appreciated, if the workpiece is something other than a length of cloth, then a different holding arrangement for the workpiece could be advantageous.

A working head is this case, a direct drive sewing machine 17, includes a working element, in this case, a sewing needle 19 driven by motor M. The working head is mounted on a working head mounting frame 21, and the frame includes a working surface 20. The frame is mounted on the working head movable carriage 23 which is movable along a second, Y axis, transverse to the X axis, on guide shafts 25. A displacing element, shown generally at 27, is fixedly secured to the bottom of the frame 21 such that the center line of the element 27 is aligned with the center line of the working element needle 19. The displacing element includes a stem 28 and a cam engaging member such as a roller 29.

It will, of course, be appreciated that the plate 3 could be carried by the frame 21 and the displacing element could be carried by the frame 7 in accordance with the invention. In addition, instead of having a plate with a cam slot, the plate 3 could be shaped in the shape of the cam and the roller would then be aligned to roll along the edge of the plate 3. It is only necessary that means be mounted on one of the carriages for engaging with means mounted on the other one of the carriages such that, when one of the carriages is driven by a motor (as will be discussed below), and the other carriage is disengaged from the motor, the displacement motion of the other carriage will be influenced by the motion of the one carriage. The illustrated embodiment is only one example of such a means.

Turning now to FIG. 2, it will be seen that sensing means, such as switches 31 and 33, are disposed at the corners of the cam slot where there is a change of direction of more than 45° in the cam slot.

A single motor (not shown) is adapted to engage either carriage 23 or carriage 7 to provide a driving force for the carriage, and to disengage the other one of the carriages. The disengaged carriage is free to travel under the influence of the displacing element and cam slot.

In order to consider the operation of the device, attention is directed to FIG. 2. Assuming now that the roller of the displacing element is at A, the free end of leg 5*a* of the cam slot 5, the motor will be engaging the carriage 23 to drive the head along the Y axis in the direction +Y in FIG. 2 so that the roller 29 will roll from (a) to (b) along leg 5*a* of cam slot 5. Carriage 7 is disengaged and free to move under the influence of the interaction between the roller and the cam slot so that the carriage 7 will move in the +X direction, and the motion of the working element relative to the workpiece will be defined by the shape of the leg 5*a* of the cam slot 5. When the roller reaches the corner (b), it will trigger the switch 31 whereupon the motor will disengage from carriage 23 and engage carriage 7. The carriage 7 will now be drivingly displaced in the −X axis in the direction shown in FIG. 2, and the carriage 23 will be moved in the Y axis in the path determined by the portion of the slot 5 bridging the portions 5*a* and 5*b*. Once again, the path of the working element relative to the workpiece will be defined by the bridging part of the cam slot. When the roller reaches the corner C of the cam slot, it will trigger the switch 33 and the motor will be disengaged from the carriage 7 and engaged to the carriage 23. The carriage 23 will now be drivingly displaced by the motor in the direction −Y opposite to the direction that it was driven when it was travelling on the path A-B. This is also shown in the arrow in FIG. 2. When the roller 29 reaches the end D of the leg 5*b*, work on this particular workpiece will be completed, and the workpiece could be removed from the machine. A new workpiece will then be disposed on the arms 13 and clamped in place by the clamps 15. Carriage 7 could then be repositioned so that the roller 29 is once again disposed at the free end A of the leg 5*a* of the cam slot. Alternatively, the machine could be designed so that the second workpiece would be worked on in direction D to C, C to B and B to A. Stop switches could be disposed at the ends D and A of the legs 5*b* and 5*a* respectively as appropriate.

It is within the present invention to cover any obvious modifications of the preferred example described herein, provided such modifications fall within the scope of the appended claims.

I claim:

1. A profiling system comprising a profile member having a profile guide element, said profile member being secured to a first displaceable frame which is displaceable along a first straight axis, a working head fixedly secured relative to a work support surface and spaced relative to said profile member, said working head and support surface being mounted on a head support frame displaceable along a second straight axis extending transversely to said first axis, support means secured relative to said profile member and displaceable therewith to retain and displace a material to be worked on by said head, a follower element fixedly secured to said head support frame and displaceably engaged with said profile guide element, said head support frame being displaced along said second axis in response to angular deviations from said first straight axis as defined by a path delineated by said profile guide element as said profile member is drivingly displaced along said first axis, said profile member being displaced along said first axis in response to angular deviation from said second axis as defined by said path as said head support frame is drivingly displaced along said second axis, and drive means selectively engaged to said first displaceable frame and said head support frame to selectively displace said frames along their respective straight axis.

2. A system as claimed in claim 1 wherein said drive means is selectively engaged to either said frames in response to sensing means associated with said profile guide element.

3. A system as claimed in claim 2 wherein said sensing means is at least one switch positioned along said profile guide element at predetermined locations where the drive displacement of said first displaceable frame and said head support frame are reversed.

4. A system as claimed in claim 3 wherein said switches are positioned at locations along said path where said angular deviation exceeds 45° from both said straight axis.

5. A system as claimed in claim 1 wherein said profile member is a guide plate, said guide element being a guide slot in a top surface of said guide plate, said guide plate being secured to said first displaceable frame.

6. A system as claimed in claim 5 wherein said follower element is a pin having a wheel engaged in said slot, said pin being axially aligned with a working element secured to said working head.

7. A system as claimed in claim 6 wherein said support means comprises a pair of clamps, each clamp being disposed adjacent a respective end of said slot above said guide plate to secure said material to be worked on over said work support surface to displace the material thereon as said guide plate is displaced.

8. A system as claimed in claim 6 wherein said working head is a sewing machine head, said working element being a sewing needle.

* * * * *